US010159276B2

(12) United States Patent
Fath et al.

(10) Patent No.: US 10,159,276 B2
(45) **Date of Patent: *Dec. 25, 2018**

(54) PACKAGING SLEEVE

(71) Applicant: Altria Client Services LLC, Richmond, VA (US)

(72) Inventors: Scott Fath, Richmond, VA (US); Ryan J. Sousa, Mechanicsville, VA (US); Steven R. Rinehart, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,619

(22) Filed: Feb. 9, 2018

(65) Prior Publication Data

US 2018/0160729 A1 Jun. 14, 2018

Related U.S. Application Data

(60) Continuation of application No. 14/547,927, filed on Nov. 19, 2014, now Pat. No. 9,918,493, which is a division of application No. 13/843,449, filed on Mar. 15, 2013, now Pat. No. 8,915,365.

(51) Int. Cl.

| | |
|---|---|
| ***A24F 23/02*** | (2006.01) |
| ***B65D 77/04*** | (2006.01) |
| ***B65D 5/02*** | (2006.01) |
| ***B65D 5/04*** | (2006.01) |
| ***B65D 5/36*** | (2006.01) |

(52) U.S. Cl.

CPC ..... *A24F 23/02* (2013.01); *B65D 5/029* (2013.01); *B65D 5/0209* (2013.01); *B65D 5/0227* (2013.01); *B65D 5/04* (2013.01); *B65D 5/3621* (2013.01); *B65D 77/0426* (2013.01)

(58) Field of Classification Search

CPC ..... A24F 23/02; A24F 23/00; B65D 5/0209; B65D 5/0227; B65D 5/029; B65D 5/04; B65D 77/0426; B65D 5/3621

USPC ..... 206/446, 549, 242, 273, 303; 229/938, 229/87.14, 4.5

See application file for complete search history.

(56) References Cited

U.S. PATENT DOCUMENTS

| | | | |
|---|---|---|---|
| 2,217,397 | A | 10/1940 | Armitt |
| 2,464,154 | A | 3/1949 | Roselius |
| 2,857,048 | A | 10/1958 | Johnson |

(Continued)

FOREIGN PATENT DOCUMENTS

WO WO 2012/138267 A1 10/2012

OTHER PUBLICATIONS

Partial International Search dated Jul. 15, 2014 for PCT/US2014/025712.

(Continued)

*Primary Examiner* — Steven A. Reynolds

(74) *Attorney, Agent, or Firm* — Buchanan Ingersoll & Rooney LLP

(57) ABSTRACT

A sleeve operable to at least partially contain two cylindrical articles in side-by-side or back-to-back relation, the sleeve including first and second openings or a single opening in a bottom thereof and the first and second cylindrical articles contained within the sleeve such that portions of the first and second cylindrical articles are exposed outside the sleeve.

17 Claims, 6 Drawing Sheets

(56) References Cited

U.S. PATENT DOCUMENTS

| | | | | |
|---|---|---|---|---|
| 3,391,782 | A | 7/1968 | Kaspar | |
| 3,469,680 | A | 9/1969 | Walz | |
| 3,638,851 | A | 2/1972 | Offer et al. | |
| 3,912,074 | A | 10/1975 | Vargo | |
| 4,170,295 | A | 10/1979 | Kuehl et al. | |
| D291,389 | S | 8/1987 | Crymes | |
| 4,802,233 | A * | 1/1989 | Skamser | A47J 47/145 206/545 |
| 5,438,815 | A | 8/1995 | Fleuren | |
| 5,476,215 | A | 12/1995 | Baroud | |
| 5,642,866 | A | 7/1997 | Nieding | |
| 5,682,986 | A | 11/1997 | Cobler | |
| D387,897 | S | 12/1997 | Yorke et al. | |
| 5,794,842 | A | 8/1998 | Hallam | |
| D435,439 | S | 12/2000 | Jaffe et al. | |
| 6,203,035 | B1 | 3/2001 | Ondrasik | |
| 7,124,890 | B2 | 10/2006 | McLeod et al. | |
| 7,762,450 | B2 | 7/2010 | Oliveira | |
| 8,225,985 | B2 | 7/2012 | Oliveira | |
| 8,393,465 | B2 | 3/2013 | Clark et al. | |
| 8,469,187 | B2 | 6/2013 | Wattenbarger et al. | |
| 8,517,250 | B2 | 8/2013 | Philips | |
| 8,550,093 | B2 | 10/2013 | Saint-Girons et al. | |
| D706,642 | S | 6/2014 | Fath | |
| 8,851,292 | B2 | 10/2014 | Meyer et al. | |
| 8,915,365 | B2 | 12/2014 | Fath et al. | |
| 2003/0183542 | A1 | 10/2003 | Bordon et al. | |
| 2010/0237137 | A1 * | 9/2010 | Oliveira | B65D 5/02 229/107 |
| 2013/0295241 | A1 | 11/2013 | Wesby et al. | |
| 2013/0334293 | A1 | 12/2013 | Coatney et al. | |

OTHER PUBLICATIONS

International Search Report and Written Opinion dated Oct. 6, 2014 for PCT/US2014/025712.

* cited by examiner

FIG. 8
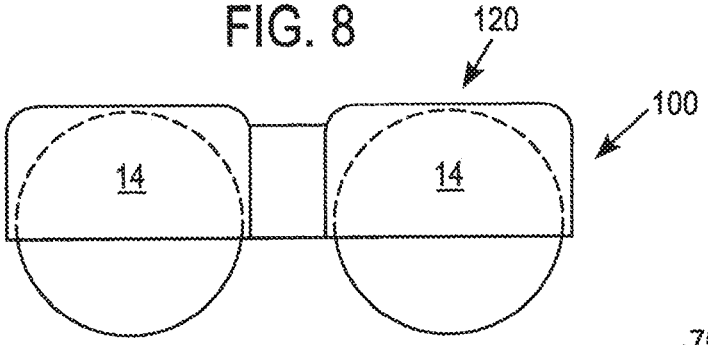
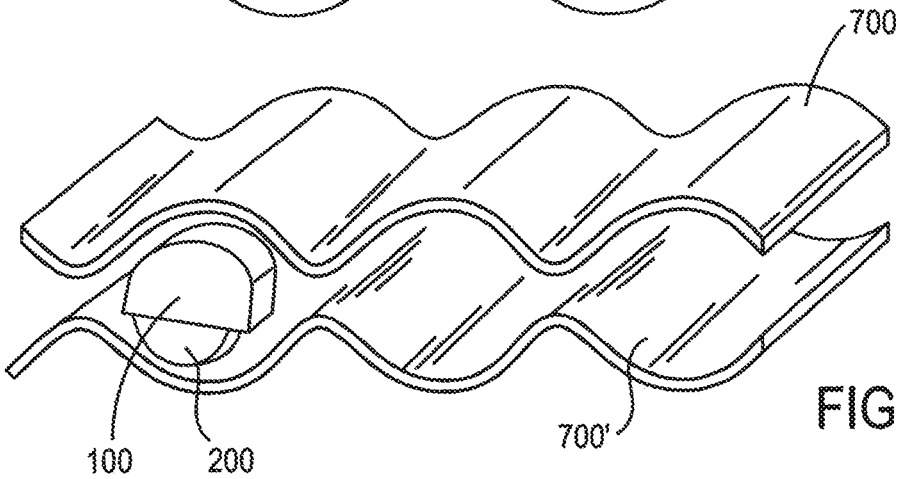
FIG. 9
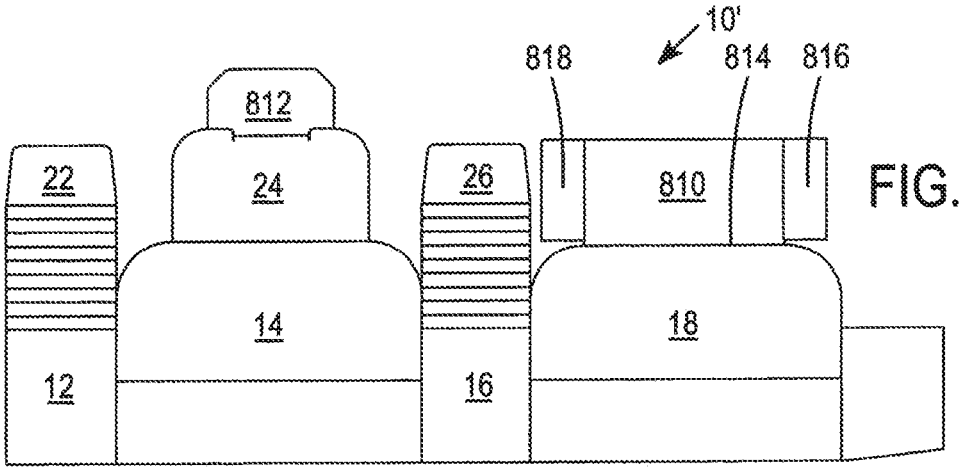
FIG. 10
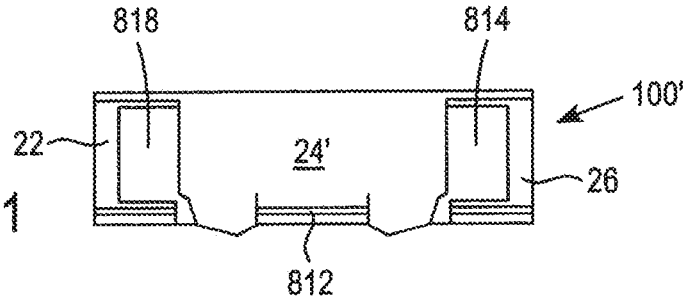
FIG. 11

PACKAGING SLEEVE

CROSS-REFERENCE TO RELATED APPLICATION

This application is a continuation application of U.S. patent application Ser. No. 14/547,927, filed Nov. 19, 2014, which is a divisional application of U.S. patent application Ser. No. 13/843 449, filed Mar. 15, 2013, now U.S. Pat. No. 8,915,365, issued Dec. 23, 2014, entitled PACKAGING SLEEVE, the entire contents of which are incorporated herein by reference.

SUMMARY

In accordance with an exemplary embodiment, a sleeve operable to at least partially contain a cylindrical article is disclosed, the sleeve comprising: opposing planar side panels; bowed dust flaps extending upwardly from said side panels; front and back panels, each having rounded, upper corner portions; and overlapping top panels in superposing relation to upper portions of said bowed dust flaps, said overlapping top panels being mutually secured, whereby said bowed dust flaps are retained in a bowed condition that conforms with said rounded upper panel portions of said front and back panels.

In accordance with an exemplary embodiment, a display system is disclosed, comprising: a sleeve operable to at least partially contain a cylindrical article, the sleeve comprising: opposing planar side panels; bowed dust flaps extending upwardly from said side panels; front and back panels, each having rounded, upper corner portions; and overlapping top panels in superposing relation to upper portions of said bowed dust flaps, said overlapping top panels being mutually secured, whereby said bowed dust flaps are retained in a bowed condition essentially conforming with said rounded upper panel portions of said front and back panels; a cylindrical article at least partially retained within said sleeve, whereby a rounded lower portion of the article extends below a lower portion of said sleeve: and a display rack comprising a plurality of undulating display rack panels; said sleeve and said article retained in a space defined between adjacent members of said undulating panels.

In accordance with an exemplary embodiment, a blank for forming a sleeve operable to at least partially contain a cylindrical can, the blank comprises: a first side panel connected to a front panel along a first fold line, the first fold line extending along a first side edge of the front panel; a second side panel connected to the front panel along a second fold line, the second fold line extending along a second side edge of the front panel; a back panel connected to the second side panel along a third fold line, the third fold line extending along a first side edge of the back panel; a first glue panel connected to the back panel along a fourth fold line, the fourth fold line extending along a second side edge of the back panel; a first dust panel connected to the first side panel along a top edge of the first side panel; a top panel connected to the front panel along a fifth fold line, the fifth fold line extending along a top edge of the front panel; a second dust panel connected to the second side panel along a top edge of the second side panel; a second glue panel connected to the back panel along a sixth fold line, the sixth fold line extending along a top edge of the back panel; and wherein the front panel and the back panel each have a pair of rounded edges on the top edge thereof, and wherein each of the first and second dust panels has a plurality of spaced-apart parallel fold lines, which allows the first and second dust panels to have a curvature thereto upon assembly of the blank into a sleeve.

In accordance with another exemplary embodiment, a method of packaging a cylindrical can into a rounded sleeve, comprises: partially erecting the sleeve from the blank so as to have an opening at a bottom of the sleeve and an opening at a top of the sleeve; plowing the first dust panel and the second dust panel into the opening at the top of the sleeve; applying an adhesive to one or more of the top panel and the second glue panel and folding the top panel and the first glue panel over the first dust panel and the second rounded panel to close the top of the sleeve; and arranging the cylindrical can in the erected sleeve such that a side of the cylindrical can extends beyond an outer periphery of the sleeve.

In accordance with a further exemplary embodiment, a package containing a plurality of sleeves, each of which is configured to receive a cylindrical can, wherein each of the plurality of sleeves is erected from a blank comprises: a first side panel connected to a front panel along a first fold line, the first fold line extending along a first side edge of the front panel; a second side panel connected to the front panel along a second fold line, the second fold line extending along a second side edge of the front panel; a back panel connected to the second side panel along a third fold line, the third fold line extending along a first side edge of the back panel; a first glue panel connected to the back panel along a fourth fold line, the fourth fold line extending along a second side edge of the back panel; a first dust panel connected to the first side panel along a top edge of the first side panel; a top panel connected to the front panel along a fifth fold line, the fifth fold line extending along a top edge of the front panel; a second dust panel connected to the second side panel along a top edge of the second side panel; a second glue panel connected to the back panel along a sixth fold line, the sixth fold line extending along a top edge of the back panel; and wherein the front panel and the back panel each have a pair of rounded edges on the top edge thereof, and wherein each of the first and second dust panels has a plurality of spaced-apart parallel fold lines, which allows the first and second dust panels to have a curvature thereto upon assembly of the blank into a sleeve.

BRIEF DESCRIPTION OF THE DRAWINGS

The disclosure is explained below with reference to the exemplary embodiments shown in the drawings. In the drawings:

FIG. 8 is a side view of a dual sleeve packaging system in accordance with an exemplary embodiment.

FIG. 9 is a partial, detail perspective view of a display rack together with a can and sleeve in accordance with an exemplary embodiment.

FIG. 10 is a planar view of a blank of another embodiment including a tuck-flap closure.

FIG. 11 is a top view of a sleeve constructed from the blank of FIG. 10.

DETAILED DESCRIPTION

In accordance with an exemplary embodiment, a blank for forming a sleeve operable to contain a discus shaped container such as a cylindrical can is disclosed. The cylindrical can be held securely within the sleeve such that the cylindrical can fits into moist smokeless tobacco can display racks located at retail outlets. The sleeve is designed to expose the lower portion of the cans so as to prevent interference from occurring on gravity feed and rail systems used in the display racks. In addition, the visibility of portions of the cans also aids consumers in identifying the product they wish to purchase.

Figure 1A:
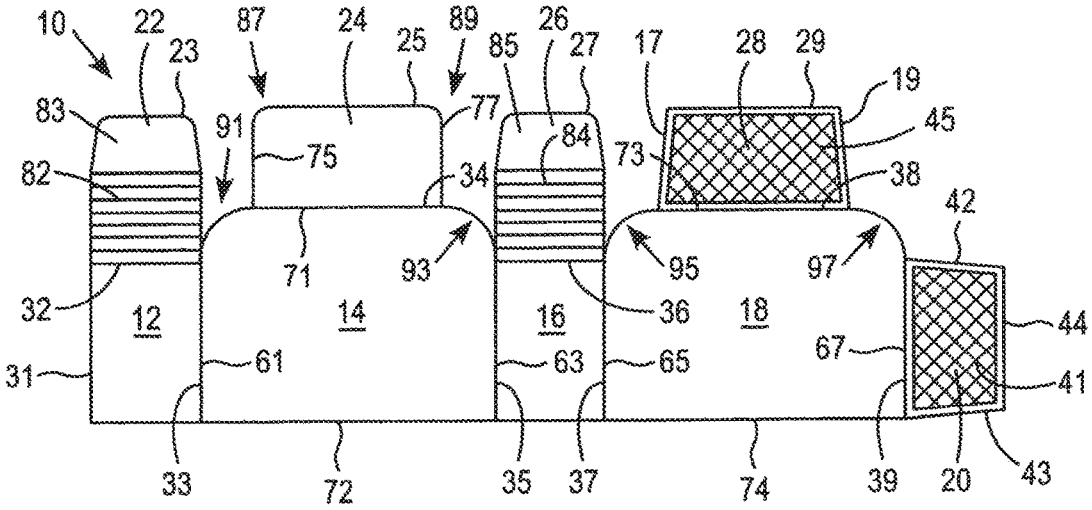
FIG. 1*a* is a blank for forming a rounded sleeve for containing a cylindrical can in accordance with an exemplary embodiment.

As shown in FIG. 1*a*, a blank 10 for forming a sleeve 100 operable to at least partially contain a cylindrical can 200 (FIG. 3) is disclosed. The blank 10 includes a first side panel 12, which is connected to a front panel 14 along a first fold line 33. The first fold line 33 extends along a first side edge 61 of the front panel 14. A second side panel 16 is connected to the front panel 14 along a second fold line 35. The second fold line 35 extends along a second side edge 63 of the front panel 14. A back panel 18 is connected to the second side panel 16 along a third fold line 37. The third fold line 37 extends along a first side edge 65 of the back panel 18. In accordance with an exemplary embodiment, a first glue panel 20 is connected to the back panel 18 along a fourth fold line 39. The fourth fold line 39 extends along a second side edge 67 of the back panel 18.

In accordance with an exemplary embodiment, a first dust panel (or first dust flap) 22 is connected to the first side panel 12 along a top edge 32 of the first side panel 12. The first dust panel 22 has a free distal end or edge 23. The top panel 24 is connected to the front panel 14 along a fifth fold line 34. The fifth fold line 34 extends along a top edge 71 of the front panel 14. A second dust panel (or second dust flap) 26 is connected to the second side panel 16 along a top edge 36 of the second side panel 12. The second dust panel 26 has a free distal end or edge 27. A second glue panel 28 is connected to the back panel 18 along a sixth fold line 38. The sixth fold line 38 extends along a top edge 73 of the back panel 18. In accordance with an exemplary embodiment, a measured distance of the top panel 24 from one outer edge 75 to another outer edge 77 is less than a diameter of a cylindrical can 200. The top panel 24 preferably has a pair of rounded edges 87, 89 along a corresponding top edge 25.

Figure 2:
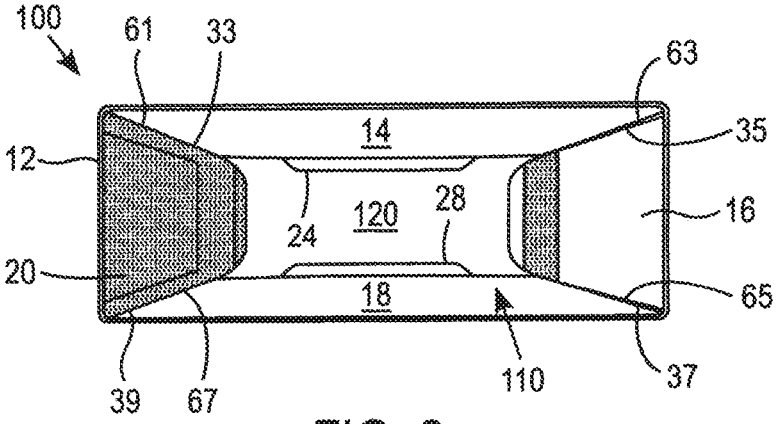
FIG. 2 is a bottom perspective view of a partially erected blank as shown in FIG. 1*a*.

In accordance with an exemplary embodiment, the front panel 14 and the back panel 18 each have a pair of rounded edges 91, 93, 95, 97 along the corresponding top edge 71, 73. The pair of rounded edges 91, 93, 95, 97 provides for a curvature or rounded edge upon assembly of the blank 10 into a sleeve 100. In addition, in accordance with an exemplary embodiment, each of the first and second dust panels 22, 26 have a plurality of spaced-apart parallel fold lines 82, 84, which extend to an outer tab portion 83, 85, which allows the first and second dust panels 22, 26 to have a curvature thereto upon assembly of the sleeve 100 (FIG. 2). In accordance with an exemplary embodiment, the outer tab portion 83, 85 is a score free portion or free of fold lines and preferably having rounded edges thereto. In accordance with an exemplary embodiment, the plurality of spaced-apart parallel fold lines 82, 84 extend from the top edge or fold line 32, 36 of the first and second side panels 12, 16, to a point or location above the top edge 71, 73 of the front and back panels 14, 18.

In accordance with an exemplary embodiment, the first and the second side panels 12, 16 have a width of about 24 mm (0.945 inches), and a height of about 35 mm (1.378 inches). The front and the back panels 14, 18 have a width of about 65.56 mm (2.581 inches) and a height of about 48 mm (1.89 inches). In accordance with an exemplary embodiment, the first and the second dust panels 22, 26 have a width of about 24 mm (0.945 inches), and a height of about (1.378 inches). The top panel 24 has a width of about 41.56 mm (1.636 inches) and a height of about 22.48 mm (0.885 inches). The first glue panel 20 has a width of about 21.5 mm (0.846 inches) and a height of about 35 mm (1.378 inches). The second glue panel 28 has a width of about 37.74 (1.486 inches) and a height of about 23 mm (0.906 inches).

In accordance with another exemplary embodiment, the first side panel 12 and the second side panel 16 can have a width of about 48 mm (1.890 inches), so as to be configured to hold two cylindrical cans 200 in a back to back relationship.

In accordance with an exemplary embodiment, the front panel 14 and the back panel 18 are substantially the same width. For example, in accordance with an exemplary embodiment, a height of the front panel 14 and a height of the back panel 18 is less than a diameter of a cylindrical can 200, such that portions of the cylindrical can 200 can extend beyond a bottom edge 72 of the front panel 14 and a bottom edge 74 of the back panel 18 when the cylindrical can 200 is inserted in an erected blank 10.

In accordance with an exemplary embodiment, the blank 10 may include a finish or varnish on the clay side of the blank 10. In accordance with an exemplary embodiment, the first glue panel 20 and the second glue panel 28 each can include a varnish free area or portion 41, 45 which may improve the bonding formed by the glue, for example, a hot-melt adhesive material. In accordance with an exemplary embodiment, the first glue panel 20 has a pair of edges 42, 43, which are slightly tapered in a direction toward a vertical free edge 44. In accordance with another exemplary embodiment, the second glue panel 28 has a pair of vertical edges 17, 19, which are slightly tapered toward a horizontal free edge 29.

FIG. 2 is a bottom view of a partially erected blank 10, which forms a sleeve (or box) 100 in accordance with an exemplary embodiment. As shown in FIG. 2, The first side panel 12, the front panel 14, the second side panel 16, the back panel 18, and the first glue panel 20 are folded approximately 90 degrees about fold lines (and/or score lines) 33, 35, 37, 39. In accordance with an exemplary embodiment, the front panel 14 and the back panel 18 are folded along the second fold line 35 and the fourth fold line 39 approximately 90 degrees. The first side panel 12 and the second side panel 14 are folded along the first fold line 33 and the third fold line 37 approximately 180 degrees so that the first side panel 12 and the first glue panel overlap 20. A glue, adhesive, and/or tape is then applied to one or more of the first side panel 12 and the first glue panel 20 to adhere the first side panel 12 and the first glue panel 20 together.

In accordance with an exemplary embodiment, the resultant box 100 structure may be flattened to facilitate shipping or its panels 12, 14, 16, 18, and 20 may be folded and glued in a flattened form for erection at a later time such as after shipping. It is preferable that the resultant box 100 is supplied by the manufacture folded and glued as set forth above. However, it is preferable that the sleeves or resultant boxes 100 are not packed tightly so as to flatten them completely. As shown in FIG. 2, the partially erected sleeve 100 includes an open bottom 110 and a partially open top 120. The partial open top 120 includes the first dust panel 22, the second dust panel 26, the top panel 24 and the second glue panel 28, which upon assembly form a closed end or top portion of the sleeve 100.

Figure 1B:
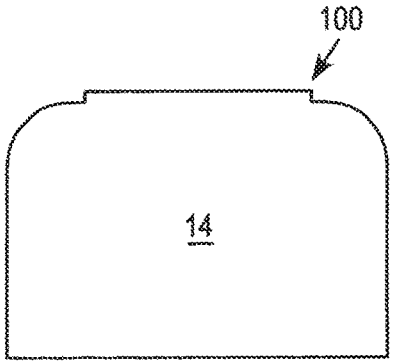
FIG. 1*b* is a side planar view of a packaging sleeve formed from a blank as shown in FIG. 1*a*.
Figure 1C:
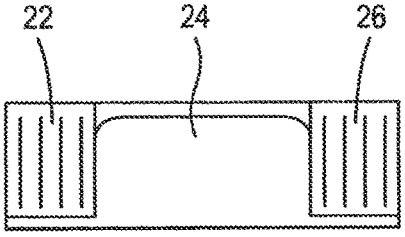
FIG. 1*c* is a top view of a packaging sleeve formed from a blank as shown in FIG. 1*a*.
Figure 3:
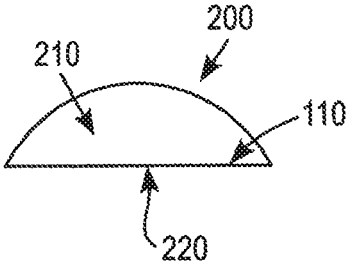
FIG. 3 is an illustration of a visible portion of a single cylindrical can within a sleeve formed from a blank as shown in FIGS. 1*a*-1*c*, and 2.

FIG. 3 is an illustration of a visible portion of a single cylindrical can 200, which is configured to fit within the rounded sleeve 100 as shown in FIGS. 1 and 2. In accordance with an exemplary embodiment, the cylindrical can 200 fits within the sleeve 100 by friction fit, wherein the transverse size or width of the inner portion of the sleeve 100 is equal to and/or slightly smaller than an outer diameter of the cylindrical can 200.

In accordance with an alternative embodiment, the sleeve 100 can be designed to receive two or more cylindrical cans 200 arranged back to back in the sleeve 100 with a portion of each can 200 extending outward of a bottom opening in the sleeve 100. In accordance with another exemplary embodiment, two or more sleeves 100 can be attached to one another in a side-by-side manner by a panel as shown in FIG. 8. For example, in accordance with an embodiment, a connection panel (not shown) can extend between two or more sleeves 100.

In accordance with an exemplary embodiment, the cylindrical can 200 contains moist smokeless tobacco. In an exemplary embodiment, the sleeve 100 can be designed to hold two or more cylindrical cans 200. The moist smokeless tobacco in the two or more cylindrical cans 200 can be the same flavor or a different flavor of moist smokeless tobacco than in the other can 200. In addition, each of the two or more cylindrical cans 200 preferably includes indicia indicating the contents of the cans 200 and wherein the indicia is exposed upon placement in the sleeve.

In accordance with an exemplary embodiment, the cylindrical can 200 is a 1.2 ounce (oz.) can of smokeless tobacco. For example, a visible portion 210 of the cylindrical can 200 has a width 220 of about 57.09 mm and a height of about 17.75 mm. In accordance with an exemplary embodiment, the regulatory label 300 (FIG. 4) are visible on the visible portion 210 of the cylindrical can 200.

Figure 4:
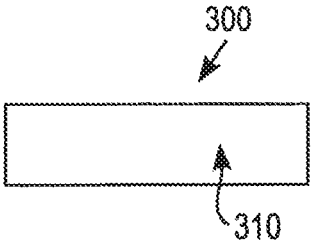
FIG. 4 is a view of an approximate size and shape of a regulatory label for a cylindrical can of moist smokeless tobacco.

FIG. 4 is a view of an approximate size of a regulatory label 300 in accordance with an exemplary embodiment, which is positioned on the front and back panels 14, 18 of the assembled sleeve 100. In accordance with an exemplary embodiment, the regulatory label 300 covers at least 30 percent of each panel 14, 18. For example, in accordance with an exemplary embodiment, the total panel area of the front panel 14 and the back panel 18 is about 3,133.07 $mm^2$ with the visible portion or area of the cylindrical can 200 is about 734.7 $mm^2$. Accordingly, a total area of the front and back panels 14, 18 of the assembled sleeve 100 and the visible portion or area 210 of the cylindrical can 200 is about 3,867.47 $mm^2$. In accordance with an exemplary embodiment, the regulatory label 300 has an area 310 of about 1,160.24 $mm^2$, which includes a width of about 65.56 mm and a height of about 17.70 mm. When placed on the front and back panels 14, 18 of the sleeve 100, the regulatory label 300 preferably comprises at least 30 percent of the visible area of the sleeve 100.

In accordance with exemplary embodiment, the blank 10 is formed of a material selected from the group consisting of cardboard, paperboard, plastic, metal, or combinations thereof. For example, in a preferred embodiment, the blank 10 is formed of cardboard having a weight ranging from about 100 grams per square meter to about 350 grams per square meter.

Preferably, the sleeve 100 finds particular application as a container for one or more cylindrical cans 200. Preferably, the one or more cylindrical cans 200 contain a moist smokeless tobacco product. Also preferably, each of the one or more cylindrical cans 200 has a diameter of about 66 mm. it will be appreciated that through appropriate choices of the dimensions thereof, the sleeve 100 may be designed for different numbers and/or sizes or dimensions of cylindrical cans 200, and the sizes and dimensions as set forth herein are only exemplary. For example, the size and dimensions of each of panels of the blank 10 and/or cylindrical cans 200 can be smaller or larger than the exemplary embodiments.

Preferably, the sleeve 100 has a height ranging from about 40 mm to about 55 mm, more preferably a height ranging from about 45 mm to about 49 mm, and most preferably about 47 mm. Also preferably, the height is measured from a bottom edge 72 of the front panel 14 to a top edge 71 of the front panel 14.

In the preferred embodiment, exterior surfaces of the sleeve 100 may be printed, embossed, debossed or otherwise embellished with manufacturer or brand logos, trademarks, slogans and other consumer information and indicia.

In another embodiment, a method for assembling the sleeve 100 from a single laminar blank 10 is provided. The laminar blank 10 including the one or more fold lines 33, 35, 37, 39, is first partially assembled by folding it along the transverse fold lines, which includes folding the side panels 12, 16 such that the side panels 12, 16 extending from the front panel 14 and the back panel 18 overlap on each side and gluing the first side panel 12 to the first glue panel 20 to form the sleeve 100.

Figure 5:
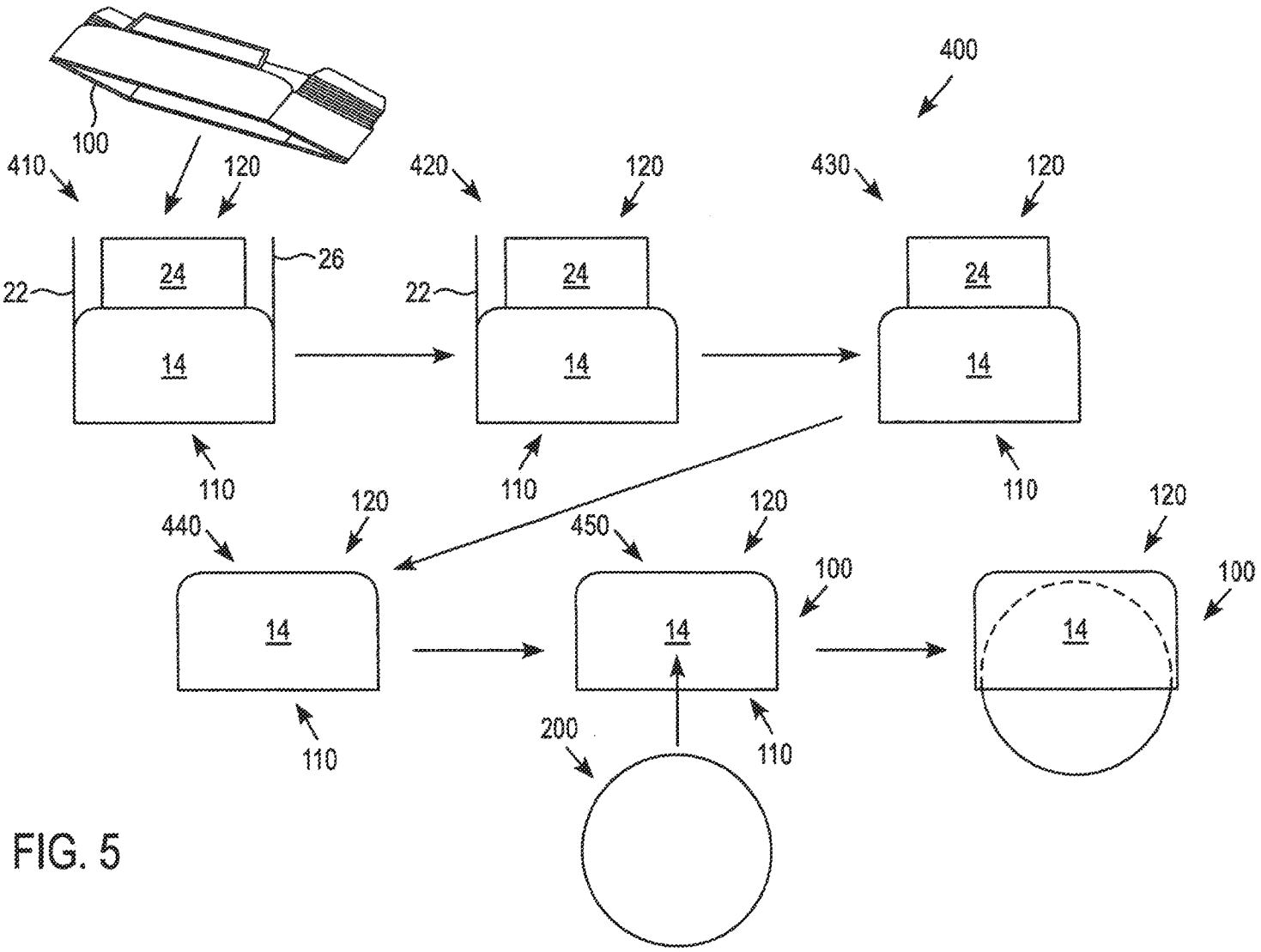
FIG. 5 is an illustration showing the assembly of a rounded sleeve being erected and an insertion of a single cylindrical can into the erected rounded sleeve in accordance with an exemplary embodiment.

Referring now to FIG. 5, in accordance with another exemplary embodiment, a method of assembling 400 a blank 10 as shown in FIG. 1 into a sleeve 100 having a cylindrical can 200 therein. The method 400 includes receiving a plurality of partially glued, un-erected sleeves or boxes 100, which have had their side panels 12 and 16 glued together. In accordance with an exemplary embodiment, it is preferable that the resultant box 100 is supplied by the manufacturer folded and glued as set forth above. In addition, it is preferable that the sleeves or resultant boxes 100 are not packed tightly within a box and/or shipping carton so as to flatten the sleeves or resultant boxes 100 completely.

In accordance with an exemplary embodiment, the flattened blank or sleeve 100 is placed in box forming machine or rotating tucker, which partially erects the sleeve 100 by pressing on one or more of the first side panel 12, the front panel 14, the second side panel 16, or the back panel 18 to reform the blank into a partially erected sleeve 100. The sleeve 100 is then fed into the forming machine or rotating tucker as shown in step 410 in an open position, wherein the first and second dust panels 22, 26 and the top panel 24 are in an open or unsealed position. In step 420, the second dust panel 26 is plowed or folded inward about the plurality of fold lines 84 closing a portion of the closed end 110 of the sleeve 100. In step 430, the first dust panel 22 is plowed or folded inward about the plurality of fold lines 82 closing a second portion of the closed end 110 of the sleeve 100. In step 440, the second glue panel 28 is plowed or folded inward about the sixth fold line 38 onto an upper edge or surface of the first and second dust panels 22, 26. A hot melt, glue or adhesive is then applied to the second glue panel 28, and the top panel 24 is plowed or folded about the fifth fold line 34 onto the second glue panel 28 to close the top portion of the sleeve. In step 450, one or more cylindrical cans 200 are inserted into the open end or bottom 110 of the sleeve 100. In accordance with an alternative embodiment, the one or more cylindrical cans 200 can be inserted into the open portion or bottom end 110 of sleeve 100 at any time during the sealing or closing of the closed portion or top end of sleeve 100. In addition, the order of plowing the first and the second dust panels 22, 26 can be reversed, wherein the first dust panel 22 can be plowed or folded inward about the plurality of fold lines 82 before the second dust panel 26 is plowed or folded about the plurality of fold lines 84.

Figure 6:
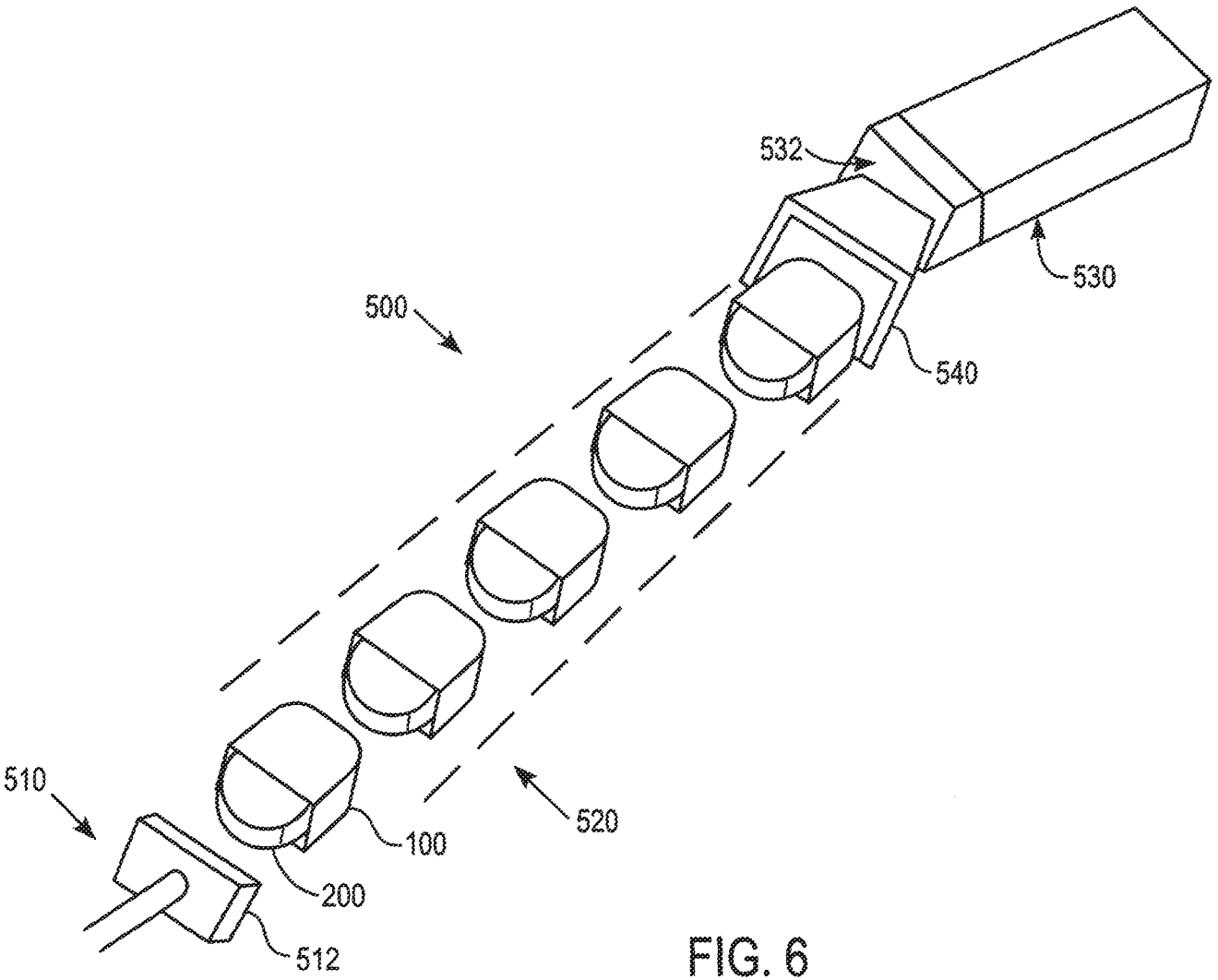
FIG. 6 is an illustration of a packaging process for one or more rounded sleeves, each containing a cylindrical can into a preformed carton.

FIG. 6 is an illustration of a packaging process 500 for one or more rounded sleeves 100, each containing a cylindrical can 200 into a preformed carton 530. In accordance with an exemplary embodiment, a plurality of packaged sleeves 520, each of the plurality of packaged sleeves 520 containing a rounded sleeve 100 and the cylindrical can 200 is inserted into a carton 530 in groups of preferably of five (5) sleeves 100. The plurality of packaged sleeves 520 are collated using a collator (not shown) into groups of packaged sleeves, for example, a group of five (5), on a conveyor tray or conveyor belt, and a plunger or rod 510 having a flat head 512 pushes the group of packaged sleeves 520 through a shoe or directing device 540 into an open end 532 of a preformed carton 530 in side-by-side manner. In accordance with an exemplary embodiment as shown in FIG. 5, the rounded or closed end 120 of the packaged sleeve enters into the carton 530 before the open end 110. Once the carton 530 has been filled, the open end 532 of the preformed carton 530 can be sealed and the product can be stored and/or shipped to consumers. Advantageously, feeding the rounded-sleeve 100 and can 200 with the rounded end 120 leading helps avoid snags during the loading of the carton 530.

Figure 7:
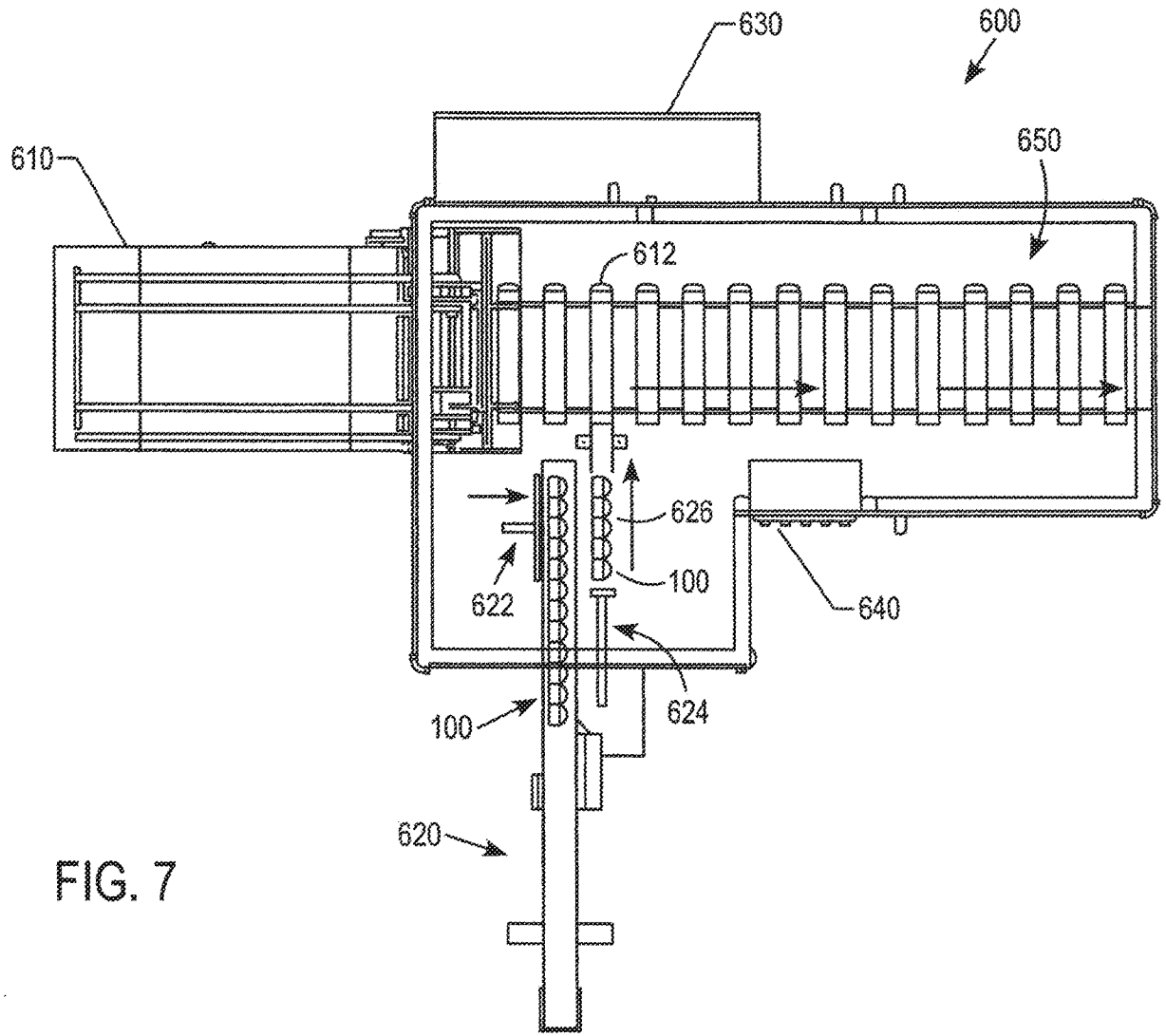
FIG. 7 is an illustration of a tobacco can packaging system in accordance with an exemplary embodiment.

FIG. 7 is an illustration of a tobacco can packaging system 600 in accordance with an exemplary embodiment. As shown in FIG. 7, the tobacco can packaging system 600 can include a powered carton magazine 610, a product infeed conveyor 620, an electrical enclosure 630, an operator interface 640 and a carton conveyor belt or system 650. The electrical enclosure 630 can include a computer processor, an operating system and software to control the operation of the tobacco can packaging system 600. In accordance with an exemplary embodiment, the operator interface 640 can include a graphical interface and/or a keyboard to assist with the operations of the various functions of the system 600.

In accordance with an exemplary embodiment, one or more packaged sleeves 100 are fed though the product infeed conveyor 620 in a single line to a collator system having a first plunger or rod 622, which separates two or more packaged sleeves 100 from the product infeed conveyor 620, and more preferably 5 packaged sleeves 100 onto a packaging tray or conveyor tray 626. Once the two or more packaged sleeves and more preferably five (5) packaged sleeves 100 have been separated, the packaged sleeves 100 are pushed or advanced forward with a plunger or rod 624 into a carton 612. In accordance with an exemplary embodiment, the carton 612 is fed from the powered carton magazine 610 onto the conveyor belt or system 650. In accordance with an exemplary embodiment, the carton 612 filled with one or more packaged sleeves 100 in a side-by-side configuration within the carton 612 as the carton 612 is conveyed along the conveyor belt or system 650. Once the carton 612 has been filled, the carton advances forward along the conveyor belt or system 650 to a device (not shown) which closes the open end of each of the cartons 612 and places a plurality of cartons 612 in a box for shipping to a warehouse, retailers and/or consumers. Advantageously, the rounded, exposed portion of the can 200 and the rounded end 120 of the sleeve 100 helps avoid snags during loading of the carton 612.

Referring now to FIG. 9, the rounded corner sleeve 100 and the can 200 may be sized to fit between undulating display rack panel 700, 700' without interference between the upper "corners" of the sleeve 100 and adjacent portions of the rack panels 700,700'. The rounded corners of the sleeve 100 avoid interference that would otherwise occur with sleeves of a more rectangular shape and having orthogonal upper corners, Referring now to FIGS. 10 and 11, in another embodiment, the sleeve blank 10' includes a modified top panel 24 and an inner top panel 810 which are closed by a tuck flap 812 of the panel 24'. The tuck flap 812 cooperates with a slot 814 provided along a lower edge portion of the inner top panel 810. Preferably, the inner top panel 810 is provided with w wing panels 816 and 818 which lie atop the dust flaps 22 and 26 when folded into the form of the sleeve 100'.

As used herein, the terms "front", "back", "upper, "lower", "side", "top", "bottom", "left", "right" and other terms used to describe relative positions of the components of the sleeve refer to the sleeve in an upright position.

As used herein, the term "can" refers to any disc-like container, regardless of material comprising the container and regardless of its content.

As used herein, the term "longitudinal" refers to a direction from bottom to top or vice versa of the sleeve 100. The term "transverse" refers to a direction perpendicular to the longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a sleeve. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A package comprising two sleeves designed to at least partially contain two cylindrical containers of smokeless tobacco in side-by-side relationship in the sleeves, each of the sleeves comprising:

a pair of side panels having free edges at lower ends thereof;

a pair of bowed dust flaps extending upwardly from upper ends of the side panels; front and back panels having rounded corner portions on upper ends thereof and free edges on lower ends thereof;

a pair of overlapping top panels overlying upper portions of the bowed dust flaps, the overlapping top panels being mutually secured, wherein the bowed dust flaps are retained in a bowed condition that conforms with the rounded corner portions of the front and back panels; and the free edges defining a rectangular opening which receives a respective one of the cylindrical containers, wherein the sleeves are attached and contain the two cylindrical containers of smokeless tobacco in side-by-side relationship.

2. The package of claim 1, wherein the pair of side panels provide a sliding fit with the respective one of the cylindrical containers.

3. The package of claim 1, wherein the front and back panels are substantially the same width.

4. The package of claim 1, wherein each of the sleeves is formed of a material selected from the group consisting of cardboard or paperboard.

5. The package of claim 4, wherein each of the sleeves is formed from a paperboard blank or cardboard blank having a weight ranging from about 100 grams per square meter to about 350 grams per square meter.

6. A method of forming the package of claim 5, comprising: erecting the sleeves from the blank so as to have two side-by-side openings at a bottom of the package and arranging the two cylindrical containers in the erected sleeves such that cylindrical side surfaces of the cylindrical containers extend outwardly of the openings of the sleeves.

7. The method of claim 6, wherein the erecting step further includes: pre-folding the blank; folding the blank; and applying glue to one or more of the side panels.

8. The package of claim 1, wherein the cylindrical containers have the same size.

9. A method of forming a package comprising two sleeves designed to at least partially contain two cylindrical containers in side-by-side relationship in the sleeves, each of the sleeves comprising a pair of side panels having free edges at lower ends thereof, a pair of bowed dust flaps extending upwardly from upper ends of the side panels, front and back panels having rounded corner portions on upper ends thereof and free edges on lower ends thereof, a pair of overlapping top panels overlying upper portions of the bowed dust flaps, the overlapping top panels being mutually secured, wherein the bowed dust flaps are retained in a bowed condition that conforms with the rounded corner portions of the front and back panels, and the free edges defining a rectangular opening which receives a respective one of the cylindrical containers, wherein each of the sleeves is formed of a material selected from the group consisting of cardboard or paperboard, each of the sleeves is formed from a paperboard blank or cardboard blank having a weight ranging from about 100 grams per square meter to about 350 grams per square meter and wherein the cylindrical containers contain smokeless tobacco having the same flavor, the method comprising:

erecting the sleeves from the blank so as to have two side-by-side openings at a bottom of the package and arranging the two cylindrical containers in the erected sleeves such that cylindrical side surfaces of the cylindrical containers extend outwardly of the openings of the sleeves.

10. A method of forming a package comprising two sleeves designed to at least partially contain two cylindrical containers in side-by-side relationship in the sleeves, each of the sleeves comprising a pair of side panels having free edges at lower ends thereof, a pair of bowed dust flaps extending upwardly from upper ends of the side panels, front and back panels having rounded corner portions on upper ends thereof and free edges on lower ends thereof, a pair of overlapping top panels overlying upper portions of the bowed dust flaps, the overlapping top panels being mutually secured, wherein the bowed dust flaps are retained in a bowed condition that conforms with the rounded corner portions of the front and back panels, and the free edges defining a rectangular opening which receives a respective one of the cylindrical containers, wherein each of the sleeves is formed of a material selected from the group consisting of cardboard or paperboard, each of the sleeves is formed from a paperboard blank or cardboard blank having a weight ranging from about 100 grams per square meter to about 350 grams per square meter and wherein the two sleeves are attached by a connection panel extending between the two sleeves, the method comprising:

erecting the sleeves from the blank, attaching the two sleeves together with the connection panel extending between the two sleeves to form a dual sleeve package with two side-by-side openings at a bottom of the package and arranging the two cylindrical containers in the erected sleeves such that cylindrical side surfaces of the cylindrical containers extend outwardly of the openings of the sleeves.

11. A sleeve containing two cylindrical containers in back-to-back relationship in the sleeve, the sleeve comprising:

a pair of opposing side panels having free edges at lower ends thereof, bowed dust flaps extending from the side panels, front and back panels having rounded corner portions at upper ends thereof and free edges at lower ends thereof, and overlapping top panels overlying upper portions of the bowed dust flaps, the overlapping top panels being mutually secured, wherein the bowed dust flaps are retained in a bowed condition, and the free edges defining a rectangular opening which receives a pair of cylindrical containers in back-to-back relationship, wherein the sleeve contains a pair of cylindrical containers in back-to-back relationship, the cylindrical containers containing smokeless tobacco.

12. The sleeve of claim 11, wherein the sleeve is formed of a material selected from the group consisting of cardboard or paperboard.

13. The sleeve of claim 12, wherein the sleeve is formed from a paperboard blank or cardboard blank having a weight ranging from about 100 grams per square meter to about 350 grams per square meter.

14. The sleeve of claim 11, wherein the side panels have a width which provides a friction fit with the two cylindrical containers in a back-to-back relationship.

15. The sleeve of claim 11, wherein each of the cylindrical containers includes indicia visible outside the sleeve.

16. A method of packaging the sleeve of claim 11, comprising partially erecting the sleeve from a cardboard or paperboard blank, and inserting the two cylindrical containers in back-to-back relationship within the sleeve such that cylindrical side surfaces of the cylindrical containers are exposed outside the sleeve.

17. A method of packaging a sleeve designed to contain two cylindrical containers in back-to-back relationship in the sleeve, the sleeve comprising a pair of opposing side panels having free edges at lower ends thereof, bowed dust flaps extending from the side panels, front and back panels having rounded corner portions at upper ends thereof and free edges at lower ends thereof, and overlapping top panels overlying upper portions of the bowed dust flaps, the overlapping top panels being mutually secured, wherein the bowed dust flaps are retained in a bowed condition, and the free edges defining a rectangular opening which receives a pair of cylindrical containers in back-to-back relationship, the method comprising partially erecting the sleeve from a cardboard or paperboard blank and inserting the pair of cylindrical containers in back-to-back relationship within the sleeve such that cylindrical side surfaces of the cylindrical containers are exposed outside the sleeve, wherein the cylindrical containers contain smokeless tobacco.

* * * * *